United States Patent [19]

Licudine

[11] 3,997,115

[45] Dec. 14, 1976

[54] PORTABLE ATOMIZER FOR LIQUIDS

[75] Inventor: Mariano B. Licudine, Pompano Beach, Fla.

[73] Assignee: Lawrence Peska Associates, Inc., New York, N.Y. ; a part interest

[22] Filed: Mar. 10, 1976

[21] Appl. No.: 665,524

[52] U.S. Cl. ..... 239/351; 239/375; 239/383; 239/222.11; 222/333

[51] Int. Cl.[2] ..... B05B 3/08

[58] Field of Search ..... 239/302, 332, 333, 350, 239/375, 418, 222.11, 306, 360, 351, 314, 383, 434, 223, 224; 222/333

[56] References Cited

UNITED STATES PATENTS

| | | | |
|---|---|---|---|
| 2,909,316 | 10/1959 | Prohaczka et al. | 416/5 |
| 3,429,510 | 2/1969 | Taylor | 239/224 X |
| 3,610,527 | 10/1971 | Ericson et al. | 239/383 X |
| 3,664,585 | 5/1972 | Curtis | 239/224 X |
| 3,901,449 | 8/1975 | Bochmann | 239/332 |

FOREIGN PATENTS OR APPLICATIONS

| | | | |
|---|---|---|---|
| 1,494,317 | 7/1967 | France | 239/332 |
| 1,544,975 | 9/1968 | France | 239/351 |

*Primary Examiner*—Robert S. Ward, Jr.
*Attorney, Agent, or Firm*—Joel Halpern

[57] ABSTRACT

A portable atomizer includes a housing in which a battery and a motor powerable by the battery are mounted. A receptacle for liquids and a vacuum pump operatively connected to the receptacle are also mounted within the housing. The motor shaft carries a bladed fan for rotation therewith externally of the housing and a sector gear engageable with a gear on the vacuum pump so that the pump can be cyclically actuated to discharge liquid into the path of the fan.

5 Claims, 3 Drawing Figures

PORTABLE ATOMIZER FOR LIQUIDS

BACKGROUND OF THE INVENTION

The invention relates to atomizers and more particularly to an atomizer of the type which can be hand held, is battery operated, and is adapted to cyclically discharge a liquid into the path of a bladed fan carried rotatably by the device.

Portable fans which are approximately the size of a pocket flashlight and are battery powered have been known heretofore. One such prior art fan device is disclosed in U.S. Pat. No. 2,909,316 issued Oct. 20, 1959 to Caroline and Stefan Probaczka. Atomizing devices are also known and include either a gaseous propellant for discharging a liquid spray or a hand operable piston pump. A common drawback of prior atomizing devices has been the concentration of a significant portion of the spray at the central region of the generally conical spray discharged and the coalescing of the particles into a liquid. This has the result that the accummulated liquid flows as a stream and stains adjacent surfaces or, when sprayed onto a person, drips from the person. Where an area of a room is to be sprayed the effective area of the spray has not been as extensive as what may have been desired.

SUMMARY OF THE INVENTION

It is one object of the invention to provide a hand held atomizing device which is portable and battery powered and is capable of discharging a liquid spray which covers a greater effective area than previously available atomizers of this character.

It is another object of the invention to provide a hand held battery powered atomizing device capable of discharging intermittent liquid sprays.

Other objects and advantages of the invention will become readily apparent from the following description of the invention.

According to the present invention there is provided a portable atomizer for liquids comprising:

a hollow housing having a discharge aperture therein;

a battery positioned within the housing;

a motor mounted within the housing operably connected to the battery and having a rotatable shaft thereon;

a bladed fan carried by the motor shaft externally of the housing for rotation with the shaft;

a receptacle for the storage of liquids mounted within the housing;

and a vacuum pump mounted with the housing operatively connected to the receptacle and drivable cyclically by the motor to pump measured quantities of liquid from the receptacle for discharge from the housing through the discharge aperture into the rotational path of the bladed fan.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
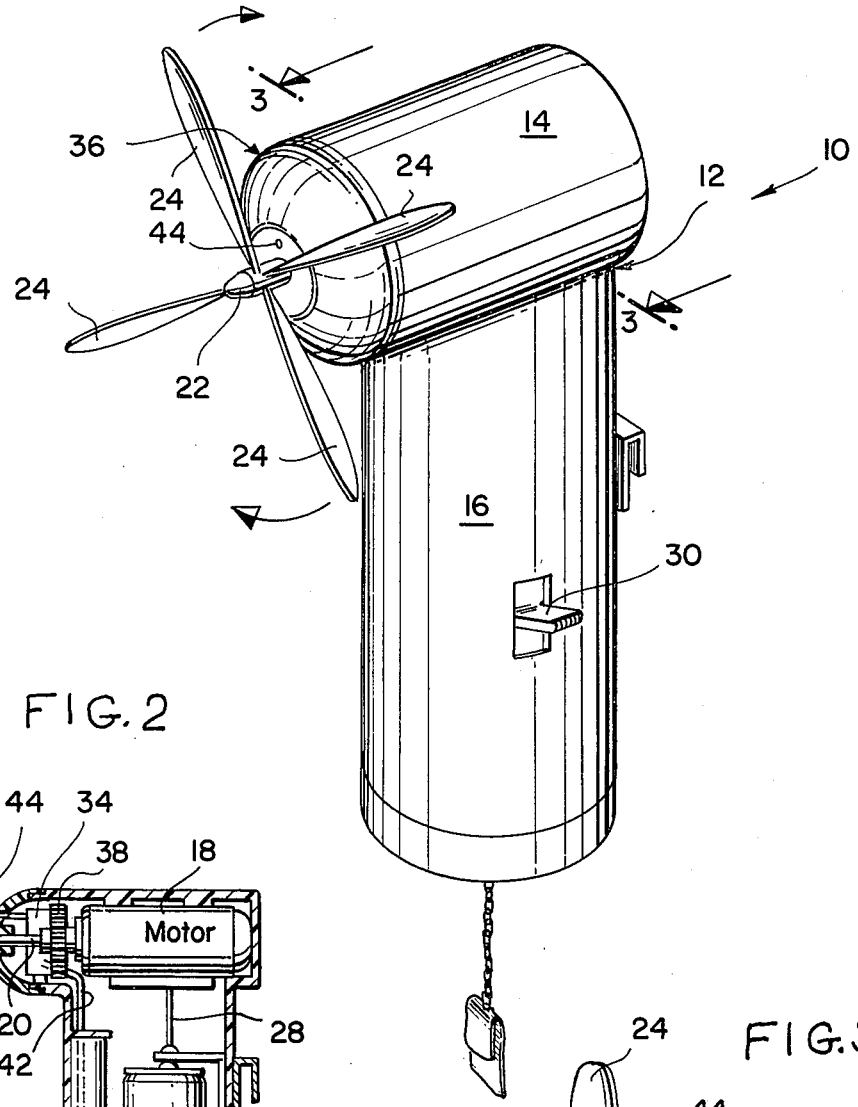
FIG. 1 is a perspective view of an atomizer embodying the features of the invention.
Figure 2:
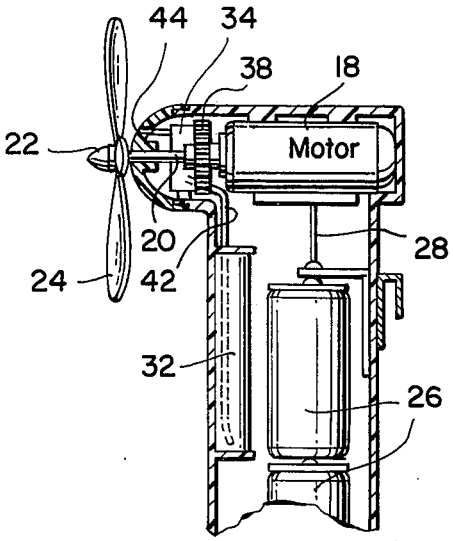
FIG. 2 is a fragmentary side view, partly in cross-section, of the atomizer shown in FIG. 1.

Referring to the drawings there is shown, as indicated generally by reference numeral 10, a portable atomizer for liquids. The device includes a hollow housing 12 which is desirably formed by an elongated motor section 14 and a handle section 16 which extends at substantially a right angle to the motor section and is joined at its upper extremity to the motor section or formed integrally therewith as when the housing is molded in one piece.

Within the motor section there is mounted an electric motor 18 which is battery powered. The motor may be any of the conventional low inertia motors employed on devices of this character where low power output is required. The motor is given a shaft 20 which extends through one end of the housing and carries a bladed fan 22 thereon for rotation therewith externally of the housing. As shown the fan has four blades 24; however, the number of blades is not critical. It is preferred that more than two blades be provided since the blades are intended to function as a dispersant for the liquid discharged and more than two blades serves to effect a better spray distribution.

The handle section of the housing mounts a battery 26 therein and such battery may be of the flashlight size. Suitable wiring 28 between the battery and motor through a switch 30 enables the motor and fan to be selectively operated.

A receptacle 32 is carried within the housing, desirably within the handle section thereof. The receptacle may be filled with any of a variety of liquids to be discharged. Thus, within the contemplation of the invention is the discharge of liquids such as insect repellants, room deodorizers, etc. which are intended to be discharged for area application. It is to be understood that pesticides, liquid fertilizer and liquid weed killers may be applied to vegetation quite effectively with the device.

Figure 3:
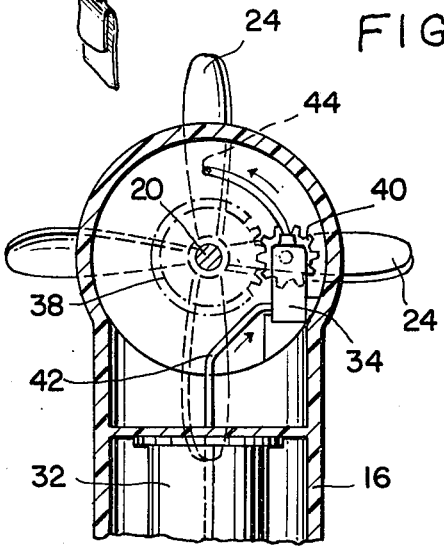
FIG. 3 is a sectional view of the principal operating components of the atomizer shown in FIG. 1 taken along line 3—3 thereof.

A vacuum pump 34 is mounted within the housing adjacent the discharge end 36 thereof. It is desirably positioned within the motor section adjacent the motor shaft since it is motor driven. Thus, a sector gear 38 is carried on the motor shaft which is cyclically engagable with a gear 40 of the vacuum pump. Gear 40 may also be a sector gear as is shown in FIG. 3. A tube 42, which is preferably of flexible rubbery material, connects the receptacle with the vacuum pump is driven by the motor and is operable to cyclically and intermittently discharge a measured quantity of the liquid through an aperture or nozzle 44 formed in the housing. By the term measured is intended a predetermined quantity of liquid dependent upon the rotational speed of the motor, the size of tube 42 and the extent of engagment between gears 38, 40.

The nozzle 44 is positioned in the discharge end of the housing so as to insure that the liquid is discharged into the rotational path of the fan blades. This enables better control of the spray area and also appears to enhance atomization of the liquid.

From the foregoing it will be seen that a portable atomizer has been provided which is compact and easy to carry and which can be used to effectively deliver an atomized liquid spray to an area to be treated.

I claim:

1. A portable atomizer for liquids comprising:

a hollow housing having a discharge aperture therein;

a battery positioned within said housing;

a motor mounted within said housing operably connected to said battery and having a rotatable shaft thereon;

a bladed fan carried by said motor shaft externally of said housing for rotation with said shaft;

a receptacle for the storage of liquids mounted within said housing;

and a vacuum pump mounted within said housing operatively connected to said receptacle and drivable cyclically by said motor to pump measured quantities of liquid from said receptacle for discharge from said housing through said discharge aperture into the rotational path of said bladed fan.

2. A portable atomizer according to claim 1, including a sector gear on said motor shaft and a gear on said vacuum pump engagable by said sector gear for actuation of said pump.

3. A portable atomizer according to claim 2, wherein said gear on said vacuum pump is a sector gear.

4. A portable atomizer according to claim 1, wherein a flexible tube operatively connects said vacuum pump and receptacle.

5. A portable atomizer according to claim 1, wherein said housing includes a first elongated motor section within which said motor is mounted and having said discharge aperture in one end thereof and a second handle section disposed at substantially a right angle to said first section, said receptacle being mounted within said handle section.

* * * * *